US007461975B2

(12) United States Patent
McCarthy, Jr.

(10) Patent No.: US 7,461,975 B2
(45) Date of Patent: Dec. 9, 2008

(54) METHOD AND SYSTEM FOR COOLING HEAT-GENERATING COMPONENT IN A CLOSED-LOOP SYSTEM

(75) Inventor: Joseph H. McCarthy, Jr., Dayton, OH (US)

(73) Assignee: Tark, Inc., Dayton, OH (US)

( * ) Notice: Subject to any disclaimer, the term of this patent is extended or adjusted under 35 U.S.C. 154(b) by 161 days.

(21) Appl. No.: 11/302,466

(22) Filed: Dec. 13, 2005

(65) Prior Publication Data

US 2006/0140346 A1 Jun. 29, 2006

Related U.S. Application Data

(63) Continuation-in-part of application No. 10/631,179, filed on Jul. 31, 2003, now Pat. No. 7,093,977, which is a continuation-in-part of application No. 09/745,588, filed on Dec. 21, 2000, now Pat. No. 6,623,160.

(51) Int. Cl.
*H01J 35/10* (2006.01)

(52) U.S. Cl. ..... 378/200; 378/199; 62/115; 62/259.2

(58) Field of Classification Search ..... 378/130, 378/141, 199, 200; 62/115, 259.2
See application file for complete search history.

(56) References Cited

U.S. PATENT DOCUMENTS 2,265,108 A 12/1941 Berman
3,584,440 A 6/1971 Vigil
4,019,983 A 4/1977 Mandt
4,136,565 A 1/1979 Migrin et al.
4,250,715 A 2/1981 Ratliff
4,282,172 A 8/1981 McKnight
4,308,835 A 1/1982 Abbey
4,343,155 A 8/1982 Stinson
4,345,440 A 8/1982 Allen et al.
4,367,194 A 1/1983 Schenewerk et al.
4,387,685 A 6/1983 Abbey
4,471,907 A 9/1984 Gerstmann
4,739,153 A 4/1988 Rendel et al.
4,767,961 A 8/1988 Koller et al.

(Continued)

FOREIGN PATENT DOCUMENTS

JP 4248414 9/1992
WO WO 99/31441 6/1999

OTHER PUBLICATIONS

"W. E. Anderson Duotech® Pressure Switches/Flotech® Pressure Switches/Midwest Sight Flow Indicators/Conductivity Controls Shoe Testers" Bulletin J-20, © 1997 Dwyer Instruments, Inc. printed in USA Jun. 1997, Dwyer Instruments, Inc. 102 Highway 212, P.O. Box 373, Michigan City, IN 46361.

(Continued)

*Primary Examiner*—Allen C. Ho
(74) *Attorney, Agent, or Firm*—Jacox, Meckstroth & Jenkins

(57) ABSTRACT

A system and method for reducing or eliminating pump cavitation in a closed system having at least one or a plurality of fluid phase changes. The system comprises a venturi having a throat which is coupled to a reservoir tank.

29 Claims, 13 Drawing Sheets

U.S. PATENT DOCUMENTS

| | | | | |
|---|---|---|---|---|
| 4,927,337 | A | 5/1990 | Lustwerk | |
| 4,954,321 | A | 9/1990 | Jensen | |
| 5,043,104 | A | 8/1991 | Stirling | |
| 5,085,809 | A | 2/1992 | Stirling | |
| 5,088,896 | A | 2/1992 | Nielsen et al. | |
| 5,220,940 | A | 6/1993 | Palmer | |
| 5,410,991 | A | 5/1995 | Beaudry et al. | |
| 5,509,463 | A | 4/1996 | Callaway, Sr. et al. | |
| 5,666,910 | A | 9/1997 | George, II et al. | |
| 5,676,173 | A | 10/1997 | Conrad et al. | |
| 5,732,123 | A | 3/1998 | Peralta et al. | |
| 5,868,105 | A | 2/1999 | Evans | |
| 5,880,378 | A | 3/1999 | Behring, II | |
| 5,890,880 | A | 4/1999 | Lustwerk | |
| 5,934,328 | A | 8/1999 | Conrad et al. | |
| 5,987,903 | A * | 11/1999 | Bathla | 62/129 |
| 6,419,389 | B1 * | 7/2002 | Fuchs et al. | 378/199 |
| 6,511,224 | B1 * | 1/2003 | Lu et al. | 378/199 |
| 6,519,317 | B2 * | 2/2003 | Richardson et al. | 378/130 |
| 6,596,951 | B1 * | 7/2003 | Cusack | 200/83 P |
| 6,619,841 | B2 * | 9/2003 | Lenz | 378/200 |
| 6,623,160 | B2 | 9/2003 | McCarthy, Jr. | |
| 2004/0022362 | A1 | 2/2004 | McCarthy, Jr. | |

OTHER PUBLICATIONS

"QuikPiks Gems Stock Products Catalog," Gems™ Sensors Catalog No. 600, pp. 32-33, Gems Sensors, Inc., One Cowles Road, Plainville, CT 06062-1198 USA.

"Lytron™ 1997 Catalog Total Thermal Solutions™," pp. 12-15 and 26-29, Lytron, Inc., 55 Dragon Court, Woburn, MA 01801 USA.

"Product Guide," pp. 1 and 14, Feb. 1997, Comair Rotron, 2675 Customhouse Court, San Ysidro, CA 92173,.

GE Handout, "The Heart of the System Global Tube & Detector, Electric Avenue Manufacturing Operations," pp. 1-9.

Toboldt, William. "Chapter 15 Engine Cooling Systems," Automotive Encyclopedia, pp. 189-207, Goodheart Willcox Co. 1995.

* cited by examiner 10
38
44
42a
42b
42
45
46
49
22
22a
28
32
40
34
26
36
30
50
ECU
18
16
14
12
20

FIG-5

TABLE IV

| D6 Inch | D11/D6 Inch | D11 Inch | Area Sq Inch | Area Sq Ft | Flow GPM | Flow Cu Ft/Sec | Velocity Ft/Sec | Pressure Rise Ft of Water | Pressure Rise PSIG |
|---|---|---|---|---|---|---|---|---|---|
| 0.5 | 0.322 | 0.161 | 0.020 | 0.0001 | 1 | 0.0022 | 15.76 | 3.86 | 1.68 |
| 0.5 | 0.322 | 0.161 | 0.020 | 0.0001 | 2 | 0.0045 | 31.52 | 15.43 | 6.70 |
| 0.5 | 0.322 | 0.161 | 0.020 | 0.0001 | 3 | 0.0067 | 47.28 | 34.71 | 15.08 |
| 0.5 | 0.322 | 0.161 | 0.020 | 0.0001 | 4 | 0.0089 | 63.04 | 61.71 | 26.80 |
| 0.5 | 0.322 | 0.161 | 0.020 | 0.0001 | 5 | 0.0111 | 78.80 | 96.42 | 41.88 |
| 0.5 | 0.322 | 0.161 | 0.020 | 0.0001 | 6 | 0.0134 | 94.56 | 138.85 | 60.31 |
| 0.5 | 0.375 | 0.1875 | 0.028 | 0.0002 | 1 | 0.0022 | 11.62 | 2.10 | 0.91 |
| 0.5 | 0.375 | 0.1875 | 0.028 | 0.0002 | 2 | 0.0045 | 23.24 | 8.39 | 3.64 |
| 0.5 | 0.375 | 0.1875 | 0.028 | 0.0002 | 3 | 0.0067 | 34.86 | 18.87 | 8.20 |
| 0.5 | 0.375 | 0.1875 | 0.028 | 0.0002 | 4 | 0.0089 | 46.48 | 33.55 | 14.57 |
| 0.5 | 0.375 | 0.1875 | 0.028 | 0.0002 | 5 | 0.0111 | 58.10 | 52.42 | 22.77 |
| 0.5 | 0.375 | 0.1875 | 0.028 | 0.0002 | 6 | 0.0134 | 69.72 | 75.48 | 32.78 |
| 0.5 | 0.375 | 0.1875 | 0.028 | 0.0002 | 7 | 0.0156 | 81.34 | 102.74 | 44.62 |
| 0.5 | 0.402 | 0.201 | 0.032 | 0.0002 | 1 | 0.0022 | 10.11 | 1.59 | 0.69 |
| 0.5 | 0.402 | 0.201 | 0.032 | 0.0002 | 2 | 0.0045 | 20.22 | 6.35 | 2.76 |
| 0.5 | 0.402 | 0.201 | 0.032 | 0.0002 | 3 | 0.0067 | 30.34 | 14.29 | 6.21 |
| 0.5 | 0.402 | 0.201 | 0.032 | 0.0002 | 4 | 0.0089 | 40.45 | 25.40 | 11.03 |
| 0.5 | 0.402 | 0.201 | 0.032 | 0.0002 | 5 | 0.0111 | 50.56 | 39.69 | 17.24 |
| 0.5 | 0.402 | 0.201 | 0.032 | 0.0002 | 6 | 0.0134 | 60.67 | 57.16 | 24.82 |
| 0.5 | 0.402 | 0.201 | 0.032 | 0.0002 | 7 | 0.0156 | 70.78 | 77.80 | 33.79 |
| 1.6 | 0.399 | 0.6381 | 0.320 | 0.0022 | 60 | 0.1337 | 60.20 | 56.27 | 24.44 |

LIQUID-TO-AIR EXCHANGER
102
100
104
106
108
HEAT REJECTION COMPONENT
HEAT REGENERATING COMPONENT
SECONDARY FLUID
VENTURI AND SWITCH
49,49'
PRIMARY FLUID

FIG - 11A

| TABLE VI | | | |
|---|---|---|---|
| R134a Flow GPM | °F Subcool @ Pump Inlet | °F Subcool @ Pump Outlet | °F Subcool @ in Tank* |
| 3.0 | 13.252 | 20.792 | 0.003 |
| 2.5 | 11.507 | 16.863 | 0.004 |
| 2.0 | 9.765 | 13.029 | 0.002 |
| 1.5 | 9.016 | 10.871 | 0.012 |
| 1.0 | 8.023 | 8.405 | 0.007 |
| 0.5 | 7.343 | 6.709 | 0.025 |
| | | | |
| *Tank is at Saturation | | | |

FIG - 12A

| TABLE VII* | | | |
|---|---|---|---|
| R134a Flow GPM | °F Subcool @ Pump Inlet | °F Subcool @ Pump Outlet | °F Subcool @ in Tank |
| 3.0 | -0.253 | 10.067 | -0.097 |
| 2.5 | -0.002 | 6.864 | 0.324 |
| 2.0 | 0.514 | 5.178 | 1.027 |
| 1.5 | 0.771 | 3.128 | 1.014 |
| 1.0 | 1.278 | 2.090 | 1.761 |
| 0.5 | 1.888 | 1.767 | 2.127 |
| | | | |
| * Negative values denote no subcooling | | | |

FIG - 14

TABLE V

| D6 Inch | D11/D6 Inch | D11 Inch | Area Sq Inch | Area Sq Ft | Flow GPM | Flow Cu Ft/Sec | Velocity Ft/Sec | Pressure Drop Ft of Water | Pressure Drop PSIG |
|---|---|---|---|---|---|---|---|---|---|
| 0.5 | 0.322 | 0.161 | 0.020 | 0.0001 | 1 | 0.0022 | 15.76 | -3.86 | -1.68 |
| 0.5 | 0.322 | 0.161 | 0.020 | 0.0001 | 2 | 0.0045 | 31.52 | -15.43 | -6.70 |
| 0.5 | 0.322 | 0.161 | 0.020 | 0.0001 | 2.2 | 0.0049 | 34.67 | -18.67 | -8.11 |
| 0.5 | 0.402 | 0.201 | 0.032 | 0.0002 | 1 | 0.0022 | 10.11 | -1.59 | -0.69 |
| 0.5 | 0.402 | 0.201 | 0.032 | 0.0002 | 2 | 0.0045 | 20.22 | -6.35 | -2.76 |
| 0.5 | 0.402 | 0.201 | 0.032 | 0.0002 | 3 | 0.0067 | 30.34 | -14.29 | -6.21 |
| 0.5 | 0.402 | 0.201 | 0.032 | 0.0002 | 3.5 | 0.0078 | 35.39 | -19.45 | -8.45 |
| 0.5 | 0.582 | 0.291 | 0.067 | 0.0005 | 1 | 0.0022 | 4.82 | -0.36 | -0.16 |
| 0.5 | 0.582 | 0.291 | 0.067 | 0.0005 | 2 | 0.0045 | 9.65 | -1.45 | -0.63 |
| 0.5 | 0.582 | 0.291 | 0.067 | 0.0005 | 3 | 0.0067 | 14.47 | -3.25 | -1.41 |
| 0.5 | 0.582 | 0.291 | 0.067 | 0.0005 | 4 | 0.0089 | 19.30 | -5.78 | -2.51 |
| 0.5 | 0.582 | 0.291 | 0.067 | 0.0005 | 5 | 0.0111 | 24.12 | -9.03 | -3.92 |
| 0.5 | 0.582 | 0.291 | 0.067 | 0.0005 | 6 | 0.0134 | 28.95 | -13.01 | -5.65 |
| 0.5 | 0.582 | 0.291 | 0.067 | 0.0005 | 7 | 0.0156 | 33.77 | -17.71 | -7.69 |
| 1.6 | 0.399 | 0.6381 | 0.320 | 0.0022 | 35 | 0.0780 | 35.12 | -19.15 | -8.32 |

METHOD AND SYSTEM FOR COOLING HEAT-GENERATING COMPONENT IN A CLOSED-LOOP SYSTEM

RELATED APPLICATION

This application is a continuation-in-part of U.S. patent application Ser. No. 10/631,179 filed Jul. 31, 2003, now issued as U.S. Pat. No. 7,093,977. which is a continuation-in-part of U.S. patent application Ser. No. 09/745,588 filed Dec. 21, 2000, issued as U.S. Pat. No. 6,623,160.

BACKGROUND OF THE INVENTION

1. Field of the Invention

This invention relates to a cooling system, and more particularly, it relates to a venturi used in a closed-loop cooling system to facilitate cooling a heat-generating component by raising the pressure of the fluid in the system and, therefore, the boiling point of the fluid, with the increased pressure establishing that there is flow in the closed-loop system.

2. Description of the Prior Art

In many prior art cooling systems, the fluid is absorbing heat from a heat-generating component. The fluid is conveyed to a heat exchanger which dissipates the heat and the fluid is then recirculated to the heat-generating component. The size of the heat exchanger is directly related to the amount of heat dissipation required. For example, in a typical X-ray system, an X-ray tube generates a tremendous amount of heat on the order of 1 KW to about 10 KW. The X-ray tube is typically cooled by a fluid that is pumped to a conventional heat exchanger where it is cooled and then pumped back to the heat-generating component.

In the past, if a flow rate of the fluid fell below a predetermined flow rate, the temperature of the fluid in the system would necessarily increase to the point where the fluid in the system would boil or until a limit control would turn the heat-generating component off. This boiling would sometimes cause cavitation in the pump.

The increase in temperature of the fluid could also result in the heat-generating component not being cooled to the desired level. This could either degrade or completely ruin the performance of the heat-generating component altogether.

In the typical system of the past, a flow switch was used to turn the system off when the flow rate of the fluid became too low. FIG. 6 is a schematic illustration of a venturi which will be used to describe a conventional manner of measuring the flow rate. Referring to FIG. 6, the velocity at point B is higher than at either of sections A, and the pressure (measured by the difference in level in the liquid in the two legs of the U-tube at B) is correspondingly greater.

Since the difference in pressure between B and A depends on the velocity, it must also depend on the quantity of fluid passing through the pipe per unit of time (flow rate in cubic feet/second equals cross-sectional area of pipe in $ft^2$ ×the velocity in ft./second). Consequently, the pressure difference provided a measure for the flow rate. In the gradually tapered portion of the pipe downstream of B, the velocity of the fluid is reduced and the pressure in the pipe restored to the value it had before passing through the construction.

A pressure differential switch would be attached to the throat and an end of the venturi to generate a flow rate measurement. This measurement would then be used to start or shut the heat-generating component down.

In the past, a conventional pressure differential switch measured this pressure difference in order to provide a correlating measurement of the fluid flow rate in the system. The flow rate would then be used to control the operation of the heat-generating component, such as an X-ray tube.

In the event of a power outage, it was necessary to provide a battery backup to keep the pump energized to prevent overheating of the X-ray tube. This added cost and expense to the overall system.

Unfortunately, the pressure differential switch of the type used in these types of cooling systems of the past and described earlier herein are expensive and require additional care when coupling to the venturi. The pressure differential switches of the past were certainly more expensive than a conventional pressure switch which simply monitors a pressure at a given point in a conduit in the closed-loop system.

What is needed, therefore, is a system and method which facilitates using low-cost components, such as a non-differential pressure switch (rather than a differential pressure switch), which also provides a means for increasing pressure in the closed-loop system.

SUMMARY OF THE INVENTION

It is, therefore, a primary object of the invention to provide a system and method for improving cooling of a heat-generating component, such as an X-ray tube in an X-ray system.

Another object of the invention is to provide a closed-loop cooling system which uses a venturi and pressure switch combination, rather than a differential pressure switch, to facilitate controlling cooling of one or more components in the system.

Another object of the invention is to provide a closed-loop system having a venturi whose throat is set at a predetermined pressure, such as atmospheric pressure so that the venturi can provide means for controlling cooling of the heat-generating component in the system.

In one aspect, this invention comprises a closed heat transfer system comprising a pump for pumping fluid through the closed heat transfer system, the pump comprising a pump inlet and a pump outlet, a first phase change component in which the fluid undergoes a phase change from liquid to gas, a second phase change component coupled to the first phase change component, the fluid undergoing a second phase change from gas to liquid, a venturi having a venturi inlet coupled to an outlet of the second phase change component and a venturi outlet coupled to the pump inlet, and a reservoir coupled to a throat of the venturi, the reservoir providing a throat pressure at the throat, the predetermined pressure being selected such that the fluid entering the pump inlet is subcooled.

In another aspect this invention comprises a method for reducing or preventing cavitation in a pump in a closed system in which a fluid changes phases between a liquid and a vapor, the method comprising the steps of situating a pump upstream of a first phase change component wherein the fluid changes state to a gas, situating a second phase change component downstream of the first phase change component wherein the gas changes state to a liquid, situating a venturi between the second phase change component and the pump, and situating a reservoir at a throat of the venturi, the reservoir providing a throat pressure at the throat that increases an overall system pressure so that the fluid entering the pump is subcooled.

In still another aspect, this invention comprises a cavitation preventor for subcooling fluid at an inlet of a pump situated in a closed system wherein fluid changes from liquid to gas in a first phase change component, and from gas to liquid in a second phase change component, the cavitation preventor comprising: a venturi having an outlet coupled to the inlet of the pump, and a reservoir coupled to a throat of the venturi for providing a throat pressure at the throat that controls overall system pressure so that the fluid entering the inlet of the pump is subcooled to facilitate reducing cavitation in the pump.

In yet another aspect, this invention comprises a pump cavitation prevention method for subcooling fluid at an inlet of a pump situated in a system, thereby reducing or eliminating cavitation in the pump, the method comprising: a venturi for situating in the system, and a reservoir coupled to a throat of the venturi for providing a pressure at the throat that increases overall system pressure so that the fluid entering the inlet of the pump is subcooled to cause it to either remain in the liquid phase state or change to the liquid phase state.

In still another aspect, this invention comprises a method for increasing pressure for controlling a heat-generating component in a closed-loop system comprising a plurality of components including a pump for pumping fluid in the system, the heat-generating component, a heat-rejection component and a conduit for coupling the plurality of components together, the method comprising the steps of: situating a venturi in series in the closed-loop system, and providing a vacuum switch at a throat of the venturi, situating an accumulator to the conduit in series, using the pump to cause flow in the closed-loop system, the vacuum switch causing the heat-generating component to turn off when the throat pressure at the throat becomes a predetermined negative pressure.

In yet another aspect, this invention comprises a cooling system for cooling a heat-generating component comprising: a heat-rejection component, a pump for pumping fluid to the heat-rejection component and the heat-generating component, a conduit for communicating fluid among the heat-generating component, the heat-rejection component and the pump, a venturi coupled to the conduit having a throat, an accumulator coupled to the conduit, and a switch coupled to the throat, the switch causing the heat-generating component to cease operating in response to a predetermined pressure at the throat.

These and other objects and advantages of the invention will be apparent from the following description, the appended claims, and the accompanying drawings.

BRIEF DESCRIPTION OF ACCOMPANYING DRAWING

FIG. 5 is a table representing various measurements relative to a given flow diameter at a particular flow rate;

FIG. 11A is data associated with an experiment;

FIG. 12A is data associated with another experiment;

FIG. 14 is data associated with an experiment.

DETAILED DESCRIPTION OF PREFERRED EMBODIMENT

Figure 1:
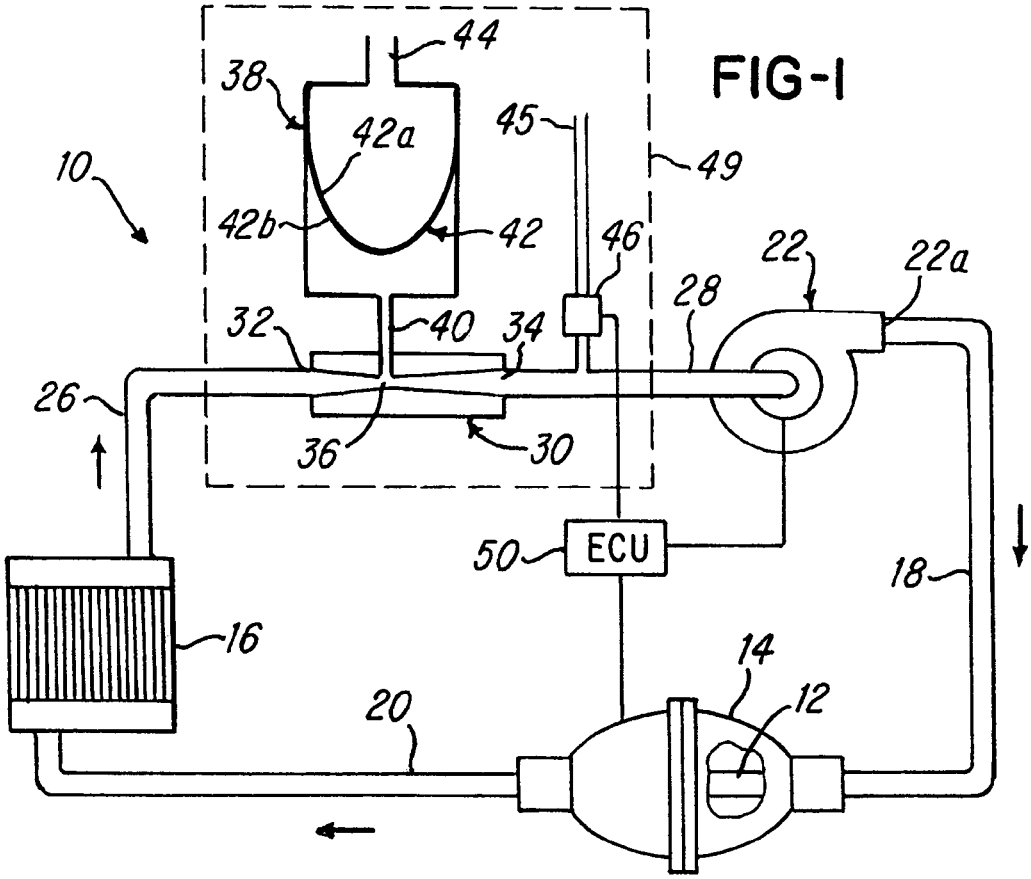
FIG. 1 is a schematic view of a cooling system in accordance with one embodiment of the invention showing a venturi having a throat coupled to an expansion tank or accumulator whose bladder is exposed to atmospheric pressure.

Referring now to FIG. 1, a cooling or closed-loop system 10 is shown for cooling a component 12. While one embodiment of the invention will be described herein relative to a cooling system for cooling the component 12 situated inside a housing 14. It should be appreciated that the features of the invention may be used for cooling any heat-generating component in the closed-loop system 10.

As mentioned, the cooling system 10 comprises a heat-generating component, such as the component 12, and a heat exchanger or heat-rejection component 16, which in the embodiment being described is a heat exchanger available from Lytron of Woburn, Mass.

The system 10 further comprises a fluid pump 22 which is coupled to housing 14 via conduit 18. In the embodiment being described, the pump 22 pumps fluid, such as a coolant, through the various conduits and components of system 10 in order to cool the components 12. It has been found that one suitable pump 22 is the pump Model No. H0060.2A-11 available from Tark, Inc. of Dayton, Ohio. In the embodiment being described, the pump 22 is capable of pumping on the order of between 0 and 10 gallons per minute, but it should be appreciated that other size pumps may be provided, depending on the cooling requirements, size of the conduits in the system 10 and the like.

In the embodiment being described, the throat 36 of venturi 30 is subject to a predetermined pressure, such as atmospheric pressure. This predetermined pressure is selected to facilitate increasing the fluid pressure in the system 10 which, in turn, facilitates increasing a boiling point of the fluid which has been found to facilitate reducing or preventing cavitation in the pump 22.

Figure 2:
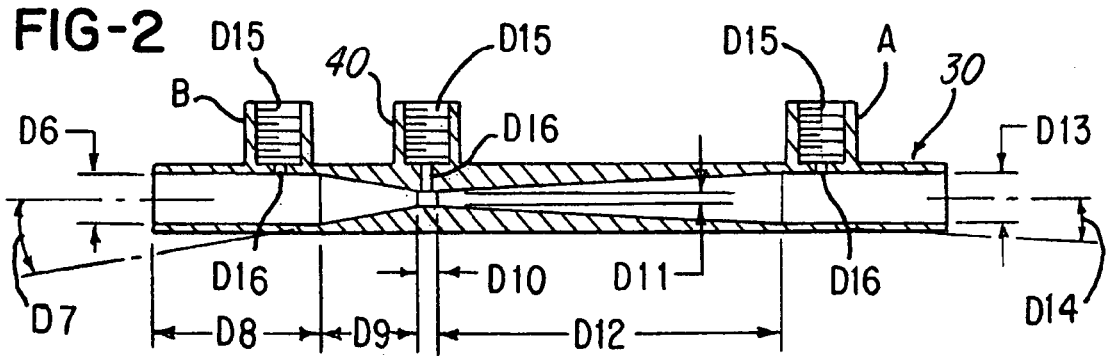
FIG. 2 is a sectional view of the venturi shown in FIG. 1.

The system 10 further comprises a venturi 30 having an inlet end 32, an outlet end 34 and a throat 36. For ease of description, the venturi 30 is shown in FIG. 2 as having downstream port A, upstream port B, and throat port 40 that are described later herein. The venturi 30 is coupled to heat-rejection component 16 via conduit 26 and pump 22 via conduit 28, as illustrated in FIG. 1. In the embodiment being described, the throat 36 of venturi 30 is coupled to an expansion tank or accumulator 38 at an inlet port 40 of the accumulator 38, as shown in FIG. 1. The accumulator 38 comprises a bladder or diaphragm 42 having a first side 42*a* exposed to atmosphere via port 44. A second side 42*b* of bladder or diaphram 42 is exposed or subject to pressure Pt, which is the pressure at the throat 36 of venturi 30, which is also atmospheric.

An advantage of this invention is that the venturi causes higher pressures and, therefore, a higher operating fluid temperature without boiling. This creates a larger temperature differential that maximizes the heat transfer capabilities of heat exchanger 16. Stated another way, raising a boiling point of the fluid in the system 10 permits higher fluid temperatures, which maximizes the heat exchanging capability of heat exchanger 16. These features of the invention will be explored later herein.

The system 10 further comprises a switch 46 situated adjacent (at port A in FIG. 2) venturi 30 in conduit 28, as illustrated in FIG. 1. In the embodiment shown in FIG. 1, the switch 46 is a non-differential pressure switch 46 that is located downstream of the venturi 30, but upstream of pump 22, but it could be situated upstream of venturi 30 (at port B illustrated in FIG. 2) if desired. As shown in FIG. 1, the switch is open, via throat 45, to atmosphere and measures fluid pressure relative to atmospheric pressure. Therefore, it should be appreciated that because the pressure Pt at the throat 36 is also at atmospheric pressure, a difference in the pressure at throat 36 compared to the pressure sensed by switch 46 can be determined. This differential pressure is directly proportionally related to the flow in the system 10. Consequently, it provides a measurement of a flow rate in the system 10.

If necessary, either port A or port B may be closed after the switch is situated downstream or upstream, respectively, of said venturi 30. It has been found that the use of the pressure switch, rather than a differential pressure switch, is advantageous because of its economical cost and relatively simple design and performance reliability. It should be appreciated that the switch 46 is coupled to an electronic control unit ("ECU") 50. The switch 46 provides a pressure signal corresponding to a flow rate of the fluid in system 10. As mentioned earlier, the switch 46 may be located either upstream or downstream of the venturi 30. This signal is received by ECU 50, which is coupled to pressure switch 46 and component 12, in order to monitor the temperature of the fluid and flow through component 12 in the system 10. Thus, for example, when a flow rate of the fluid in system 10 is below a predetermined rate, such as 5 gpm in this embodiment, then ECU 50 may respond by turning component 12 off so that it does not overheat.

Thus, the switch 46 cooperates with venturi 30 to provide, in effect, a pressure differential switch or flow switch which may be used by ECU 50 to monitor and control the temperature and flow rate of the fluid in the closed-loop system 10 in order to control the heating and cooling of component 12. It should also be appreciated that the switch 46 may be a conventional pressure switch, available from Whitman of Bristol, Conn.

The expansion tank or accumulator 38, which is maintained at atmospheric pressure, is connected to the throat 36 of venturi 30, with the venturi 30 connected in series with the main circulating loop of the closed-loop system 10. The venturi 30 and switch 46 cooperate to automatically control the pressure and temperature in the cooling system 10 by monitoring the flow of the fluid in the system 10. The pressure differential between the throat 36 and, for example, the inlet end 32 of venturi 30 remains substantially constant, as long as the flow is substantially constant.

Because the pressure Pt at the throat 36 is held at atmospheric pressure, the subsequent pressure at outlet end 34 may be calculated using the formula $(V_t-V_e)^2/2$ g, where $V_e$ is a velocity of the fluid at, for example, end 34 of venturi 30 and $V_t$ is a velocity of the fluid at the throat 36 of venturi 30.

The ECU 50 may use the determined measurement of flow from switch 46 to cause the component 12 to be turned off or on if the flow rate of the fluid in system 10 is below or above, respectively, a predetermined flow rate. In this regard, switch 46 generates a signal responsive to pressure (and indicative of the flow rate) at end 34. This signal is received by ECU 50, which, in turn, causes the component 12 to be turned off or on as desired. Advantageously, this permits the flow rate of the fluid in the system 10 to be monitored such that if the flow rate decreases, thereby causing the cooling capability of the fluid in the closed-loop system to decrease, then the ECU 50 will respond by shutting the heat-generating component 12 off before it is damaged by excessive heat or before other problems occur resulting from excessive temperatures.

Advantageously, it should be appreciated that the use of the venturi 30 having the throat 36 subject to atmospheric pressure via the expansion tank 38 in combination with the pressure switch 46 provides a convenient and relatively inexpensive way to measure the flow rate of the fluid in the system 10 thereby eliminating the need for a pressure differential switch of the type used in the past. This also provides the ability to monitor the flow rate of the fluid in the closed-loop system 10.

Figure 4:
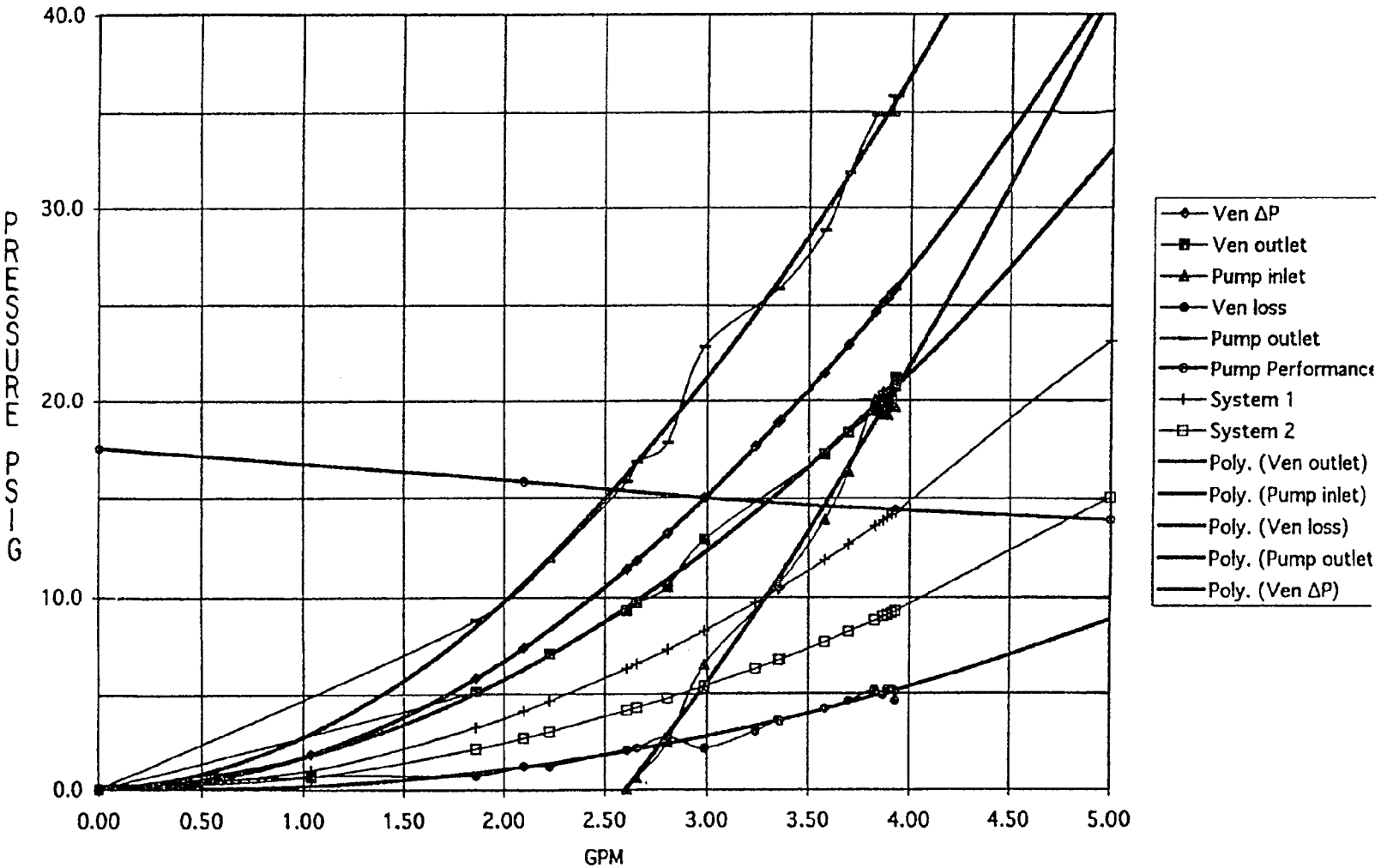
FIG. 4 are plots of the relationship between pressure and flow rate at various points in the system.
Figure 6:
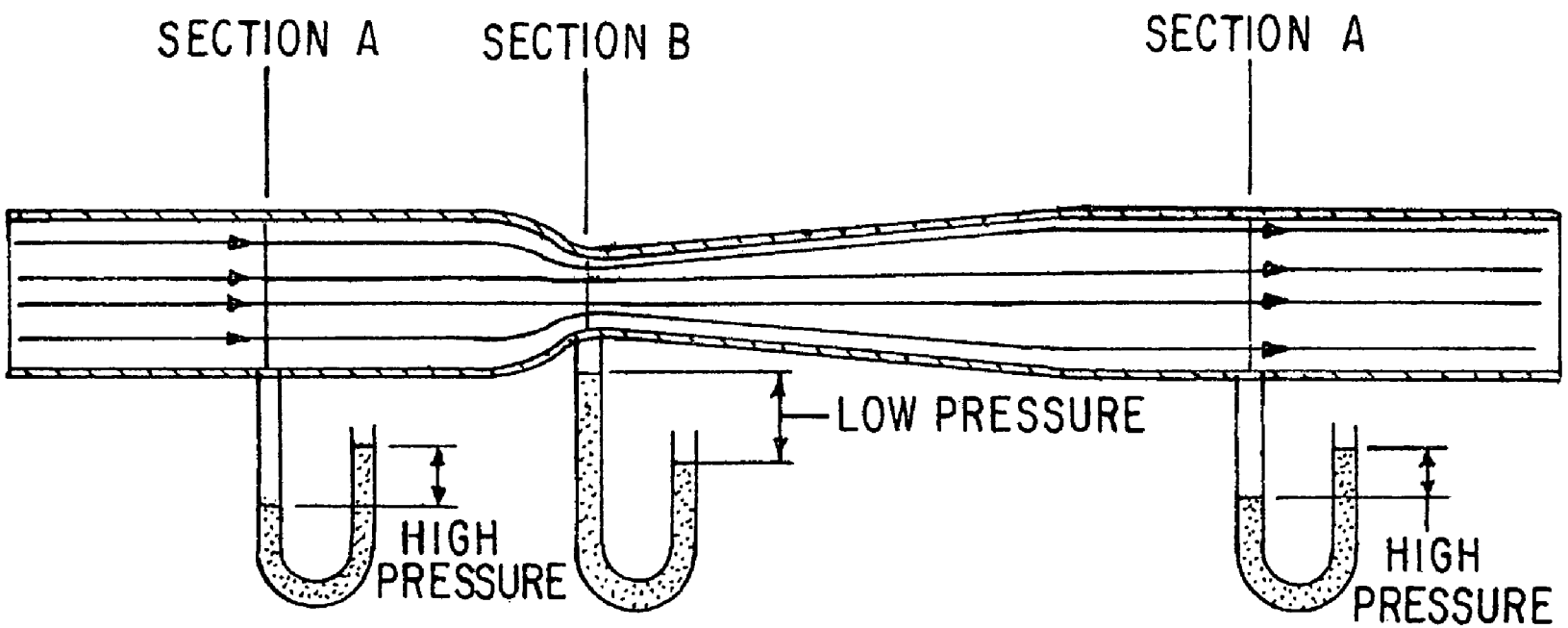
FIG-6 (PRIOR ART)
FIG. 6 is a sectional view of a venturi of the prior art.

FIG. 4 is a diagram illustrating five locations describing various properties of the fluid as it moves through the closed-loop system 10.

Neglecting minor temperature and pressure losses in the conduits 18, 20, 26 and 28. The following Table I gives the relative properties (velocity, gauge pressure, temperature) when a flow rate of the fluid is held constant at four gallons per minute.

TABLE I

| GPM | Location (FIG. 1) | Velocity (fps) | Gage Pressure (psi) | Temperature (F.) |
|---|---|---|---|---|
| 4 | 32 | 8 | 26 | 160 |
| 4 | 36 | 64 | 0 | 160 |
| 4 | 34 | 8 | 24.7 | 160 |
| 4 | 18 | 8 | 40 | 160 |
| 4 | 20 | 8 | 35 | 167 |

The following Table II provides, among other things, different venturi 30 gauge pressures and fluid velocities resulting from flow rates of between zero to 4 gallons per minute in the illustration being described. Note that the pressure at the throat 36 of venturi 30 is always held at atmospheric pressure when the expansion tank 38 is coupled to the throat 36 as illustrated in FIG. 1.

TABLE II

| | Location (FIG. 1) | | | | | |
|---|---|---|---|---|---|---|
| Flow rate | 32 Inlet Velocity (ft/sec) | 32 Inlet Pressure (psi) | 36 Throat Velocity (ft/sec) | 36 Throat Pressure (psi) | 34 Outlet Velocity (ft/sec) | 34 Outlet Pressure (psi) |
| 0 | 0 | 0 | 0 | 0 | 0 | 0 |
| 1 | 2 | 1.7 | 16 | 0 | 2 | 1.6 |
| 2 | 4 | 7 | 32 | 0 | 4 | 6.65 |
| 4 | 8 | 26 | 64 | 0 | 8 | 24.7 |

Note from the Tables I and II that when there is no flow, the fluid pressure throughout the closed-loop system 10 is that of the expansion tank or atmospheric pressure. In the closed-loop system 10, Table I shows the fluid at a minimum pressure at the throat 36 of venturi 30 and maximum on a discharge or outlet side 22*a* of pump 22. There is a pressure loss after entering and leaving the heat-generating component 12, such as the X-ray tube, heat exchanger 16 and venturi 30. Velocity is held substantially constant throughout the system 10 because the inner diameter of the conduits 18, 20, 26 and 28 are substantially the same. Fluid velocity changes only when an area of the passage it travels in is either increased or decreased, such as when the fluid is pumped from ends 32 and 34 towards and away from throat 36 of venturi 30.

If the system 10 is assumed to reach a steady state, then a temperature of the fluid in the system 10 will increase from a value before the heat-generating component 12 to a higher value after exiting the heat-generating component 12. The higher temperature fluid will cool back down to the original temperature after exiting the heat exchanger 16, neglecting small temperature changes throughout the conduits 18, 20, 26 and 28 of the system 10.

Figure 3:
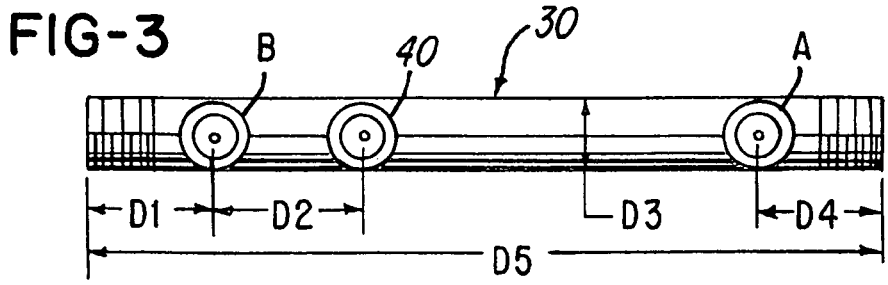
FIG. 3 is a plan view of the venturi shown in FIG. 2.

FIGS. 2 and 3 illustrate various features and measurements of the venturi 30 with the various dimensions at points D1-D16 identified in the following Table III:

TABLE III

| Dimension | Size |
|---|---|
| D1 | 1.5" |
| D2 | 1.71" |
| D3 | 0.84" |
| D4 | 1.5" |
| D5 | 9.5" |
| D6 | 0.622" |
| D7 | 10.5E |
| D8 | 2.0" |
| D9 | 1.172" |
| D10 | 0.2" |
| D11 | 0.188" |
| D12 | 4.145" |
| D13 | 0.622" |
| D14 | 3E |
| D15 | ¼" NPIF hole at 3 locations |
| D16 | 0.1" through hole at 3 locations concentric with D15 holes |

It should be appreciated that the values represented in Table III are merely representative for the embodiment being described.

Table IV in FIG. 5 is an illustration of the results of another venturi 30 (not shown) at various flow rates using varying flow rate diameters at the throat 36 (represented by dimension D11 in FIG. 2).

It should be appreciated that by holding the pressure at the throat 36 at the predetermined pressure, which in the embodiment being described is atmospheric pressure, the velocity of the fluid exiting end 34 of venturi 30 can be consistently and accurately determined using the pressure switch 46, rather than a differential pressure switch (now shown) which operates off a differential pressure between the throat 36 and the inlet end 32 or outlet end 34. Instead of using a differential pressure device (not shown) to measure flow in the system, the expansion tank, when attached to the throat 36 of venturi 30, causes the fluid in the system 10 to be at atmospheric pressure when there is zero flow. For any given flow rate, the pressure at the throat 36 of venturi 30 remains at atmospheric pressure, but a fluid velocity is developed for each cross-sectional area in the closed-loop system 10. Since the throat 36 of venturi 30 is smaller than the venturi inlet 32 and the venturi outlet 34, the velocity at the throat will be higher than the velocity at the inlet 32 or outlet 34. This velocity difference creates a pressure difference between the throat 36 of venturi 30 and the ends 32 and 34, which mandates that the pressure at the throat 36 be lower than the pressure at the ends 32 and 34. Stated another way, the pressure at the ends 32 and 34 must be higher than the pressure at the throat 36 which is held at atmospheric pressure.

Consequently, the pressure at the ends 32 and 34 must be greater than atmospheric pressure when there is flow in the system 10. This phenomenon causes the overall pressure in the system 10 to increase, which in effect, raises the effective boiling point of the fluid in the system 10. Because the boiling point of the fluid in the system 10 has been raised, this facilitates avoid cavitation in the pump 22 which occurs when the fluid in the system 10 achieves its boiling point.

Another feature of the invention is that because the boiling point of the fluid is effectively raised in the closed-loop system 10, the higher fluid temperature creates a larger temperature differential and enhances heat transfer for a given size heat exchanger 16. In the embodiment being described, the specific volume of vaporized fluid is reduced by an increase in the system pressure. By way of example, water's specific volume is 11.9 ft.$^3$/lbs. at 35 psia and 26.8 ft.$^3$/lbs. at atmospheric pressure. Thus, increasing the system pressure results in a reduction of the specific volume of the vaporized fluid. In the embodiment being described, the fluid is a liquid such as water, but it may be any suitable fluid cooling medium, such as ethylene glycol and water, oil, water or other heat transfer fluids, such as Syltherm7 available from Dow Chemical.

Advantageously, the higher pressure enabled by venturi 30 permits the use of a simple pressure switch 46 to act as a flow switch. This switch 46 could be placed at the venturi outlet 34 (for example, at port A in FIG. 2), as illustrated in FIG. 1, or at the inlet 32 (for example, at port B in FIG. 2). Note that a single pressure switch whose reference is atmospheric pressure is preferable. Because its pressure is atmospheric pressure, it does not need to be coupled to the throat 36, which is also at atmospheric pressure. Once the pressure is determined at the outlet 34 or inlet 32, a flow rate can be calculated using the formula mentioned earlier herein, thereby eliminating a need for a differential pressure switch of the type used in the past. A method for increasing pressure in the closed-loop system 10 will now be described.

The method comprises the steps of situating the venturi in the closed-loop system 10. In the embodiment being described, the venturi is situated in series in the system 10 as shown.

A predetermined pressure, such as atmospheric pressure in the embodiment being described, is then established at the throat 36 of the venturi 30. The method further uses the pump 22 to cause flow in the system 10 in order to increase pressure in the system, thereby increasing a flow rate of the fluid in the system 10 such that the pressure at the inlet 32 and outlet 34 relative to the throat 36, which is held at a predetermined pressure, such as atmospheric pressure, is caused to be increased.

In the embodiment being described, the predetermined pressure at the throat 36 is established to be the atmospheric pressure, but it should be appreciated that a pressure other than atmospheric pressure may be used, depending on the pressures desired in the system 10. Advantageously, this system and method provides an improved means for cooling a heat-generating component utilizing a simple pressure switch 46 and venturi 30 combination to provide, in effect, a switch for generating a signal when a flow rate achieves a predetermined rate. This signal may be received by ECU 50, and in turn, used to control the operation of heat-generating component 12 to ensure that the heat-generating component 12 does not overheat.

Figure 8:
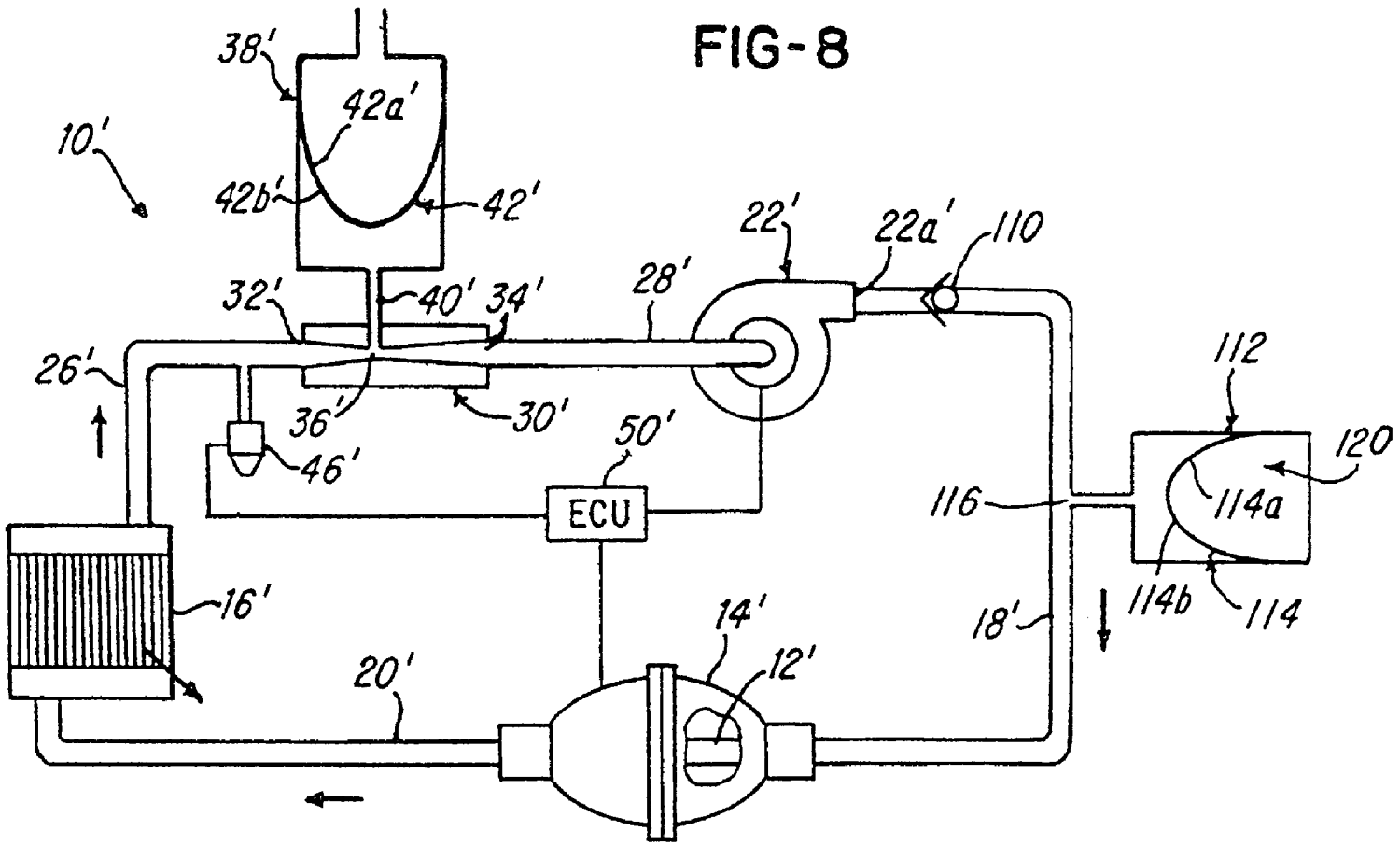
FIG. 8 is a view of a cooling system in accordance with another embodiment of the invention.

Referring now to FIG. 8, an embodiment of the invention is shown which further enhances the features of the inventions described herein. In this embodiment, those parts that are the same or similar as the parts shown related to prior embodiments are identified with the same part number, except that a prime mark ("') has been added to the part numbers for the embodiment illustrated in FIG. 8. It should be understood that these parts function in substantially the same way as the corresponding parts referred to relative to FIG. 1 described earlier herein.

In FIG. 8, a cooling system 10' is shown for cooling a component 12', such as an x-ray tube situated in a housing 14'. As mentioned earlier, it should be appreciated that the features of the invention may be used for cooling any heat-generated component.

The system 10' further comprises a fluid pump 22' having an outlet 22*a*' that is coupled to a check valve 110 as shown.

A second closed-end expansion tank or accumulator 112 is situated between the check valve 110 and the heat-generating component 12'. Note that the expansion tank 112 is closed and not open to atmosphere in contrast to the accumulator 38'.

The expansion tank or accumulator 112 comprises the bladder or diaphram 114 having a first side 114*a* and a second side 114*b* as shown. The first side 114*a* and the second side 114*b* are exposed or subject to pressure at the area 116 in conduit 18'.

As with the embodiment described earlier herein relative to FIG. 1, the embodiment shown in FIG. 8 comprises the heat exchanger 16' which is coupled to the heat-generating component 12' via conduit 20'. The heat exchanger 16' is coupled to the upstream end of venturi 30' as shown. The pressure switch 46' is situated upstream of the venturi 30' and between the venturi 30' and heat exchanger 16' as shown.

The ECU 50' is coupled to the heat-generating component 12', pressure switch 46' and pump 22' as shown.

Note that the accumulator 38' is situated at the throat 36' as shown and is open to atmosphere. The pressure switch 46' and ECU 50' cooperate to automatically control the pressure and temperature in the cooling system 10' by monitoring the flow of the fluid in the system 10'. The pressure differential between the throat 36' and, for example, the inlet end 32' of venturi 30' remains substantially constant, as long as the flow is substantially constant.

The ECU 50' may use the determined measurement of the flow from switch 46' to cause the component 12' to be turned off or on if the flow rate of the fluid in the system 10' is below or above, respectively, a predetermined flow rate. In this regard, switch 46' generates a signal responsive to pressure (and indicative of the flow rate) at end 32' of venturi 30'. This signal is received by ECU 50' which, in turn, causes the component 12' to be turned off or on as desired. Advantageously, this permits the flow rate of the fluid in the system 10' to be monitored such that if the flow rate decreases, thereby causing the cooling capability of the fluid in the closed-loop system 10' to decrease, then the ECU 50' will respond by shutting the heat-generating component 12' off before it is damaged by excessive heat or before other problems occur resulting from excessive temperatures.

The check valve 110 and closed end expansion tank 112 operate as follows. The check valve 110 is situated as shown and stops any flow from the accumulator 112 back through the pump 22' when the pump 22' stops. Thus, all flow from the second accumulator 112 to the first accumulator 38' passes through the heat-generating component 12', thereby preventing overheating of the heat-generating component 12' and the cooling fluid in system 10' because of the heat stored in the heat-generating component 12'. In a system 10' wherein the diaphragm and, for example, heat-generating component 12' are rotating, the diaphragms 42' and 114 are required. In an environment where the system 10' is not rotating, the diaphragm 42' of accumulator 38' is not required.

Before the system 10' starts providing cooling to the heat-generating component 12', any excess fluid resides in accumulator 38' and not in accumulator 112. After the pump 22' starts and as pressure in conduit 18' increases, any excess fluid moves from accumulator 38' through system 10' to accumulator 112. Any air in the area 120 of second accumulator 112 is compressed by the pressure increase caused by the venturi 30' and the pump 22'. When the pump 22' stops circulating fluid through the system 10', air pressure in the area 120 of second accumulator 112 forces the fluid into the accumulator 38' and portions of conduit 18', 20' and 26' and into accumulator 38', which is at atmospheric pressure. Note that the check valve 110 prevents fluid from flowing back through the pump 22', which causes the fluid to flow through the heat-generating component 12' even after the pump 22' is deactivated. This, in turn, facilitates cooling the heat stored in the heat-generating component 12'.

Figure 7:
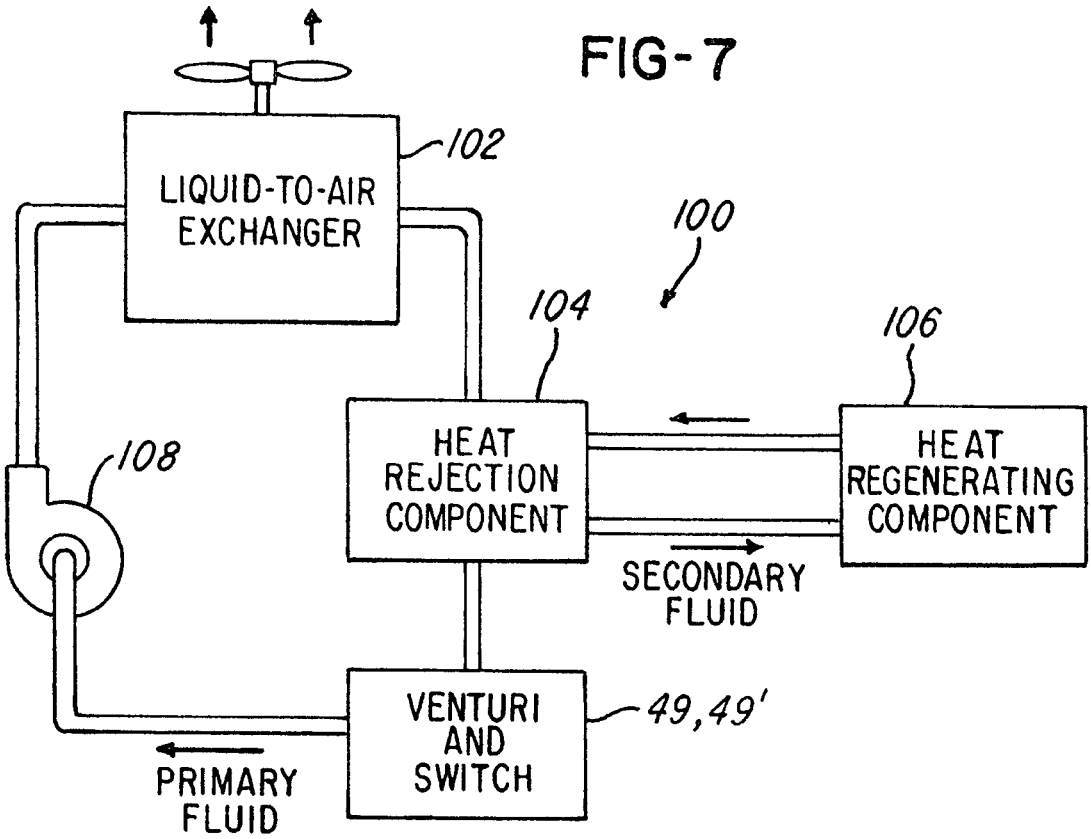
FIG. 7 is a schematic diagram of another embodiment of the invention illustrating use of the venturi a closed-loop heat exchanger that uses fluid to cool another fluid.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims. For example, while the system 10 has been shown and described for use relative to an X-ray cooling system, it is envisioned that the system may be used with an internal combustion engine, cooling system, a hydronic boiler or any closed loop heat exchanger that uses a fluid to cool another fluid. For example, note in FIG. 7 basic features of Applicant's invention are shown. The system 100 comprises a heat exchanger 102, such as a liquid to air heat exchange, and a liquid-to-liquid heat exchanger 104 for cooling a fluid, such as oil, from a heat-generating component 106. Note that the accumulator 38, venturi 30 and switch 46 configuration in FIG. 1 (labeled 49 in FIG. 1 and labeled 49, 49' in FIG. 7 ) are provided upstream of pump 108. Providing the arrangement 49 advantageously enables higher system pressure and higher operating fluid temperatures that maximizes heat transfer capabilities of heat exchangers 102 and/or 104. This design also facilitates bringing system pressure back to atmospheric pressure at substantially the same time as when the flow rate is reduced to zero.

Referring now to FIGS. 9-14, several other embodiments and associated data are shown. In the example illustration, those parts that are the same or similar as the parts shown relative to prior embodiments are identified with the same part number, except that a double prime mark ("") or triple prime mark ("""") has been added to the part numbers in the embodiments illustrated in FIGS. 9-14. It should be understood that those parts with the same number function in substantially the same way as the corresponding parts referred to earlier herein.

Figure 9:
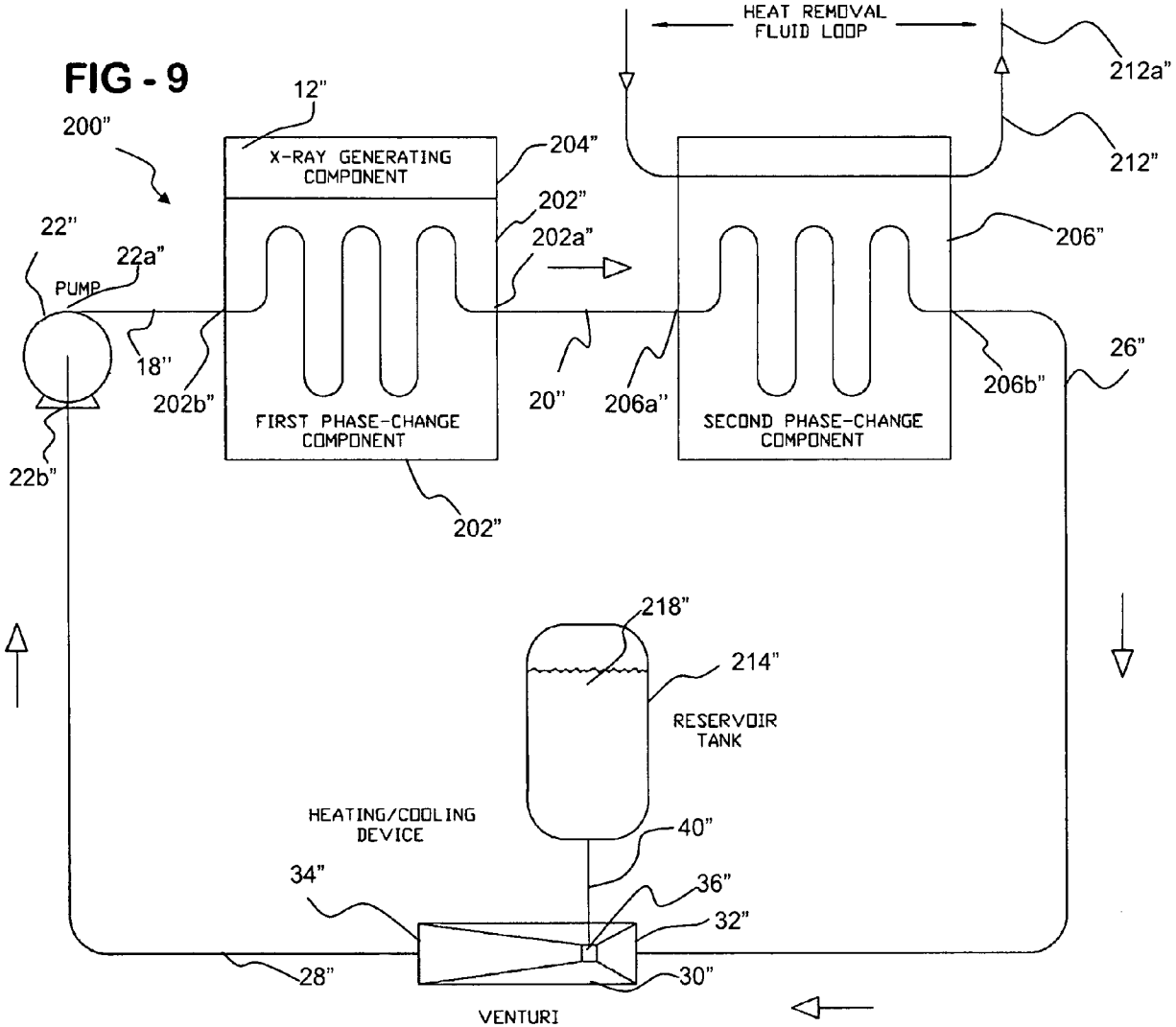
FIG. 9 is a schematic diagram of another embodiment of the invention.
Figure 10:
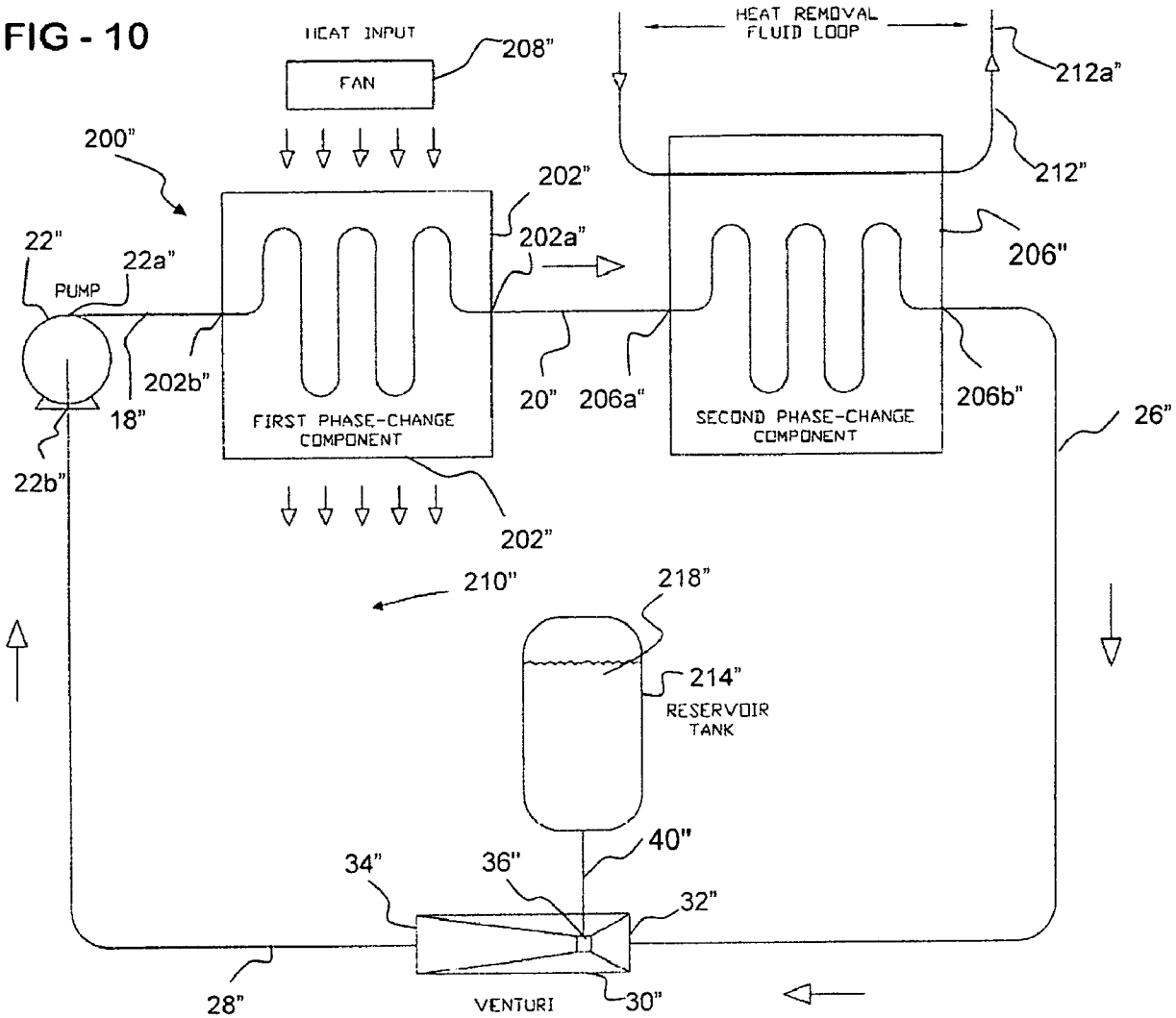
FIG. 10 is a schematic illustrating another embodiment of the invention similar to FIG. 9.
Figure 11B:
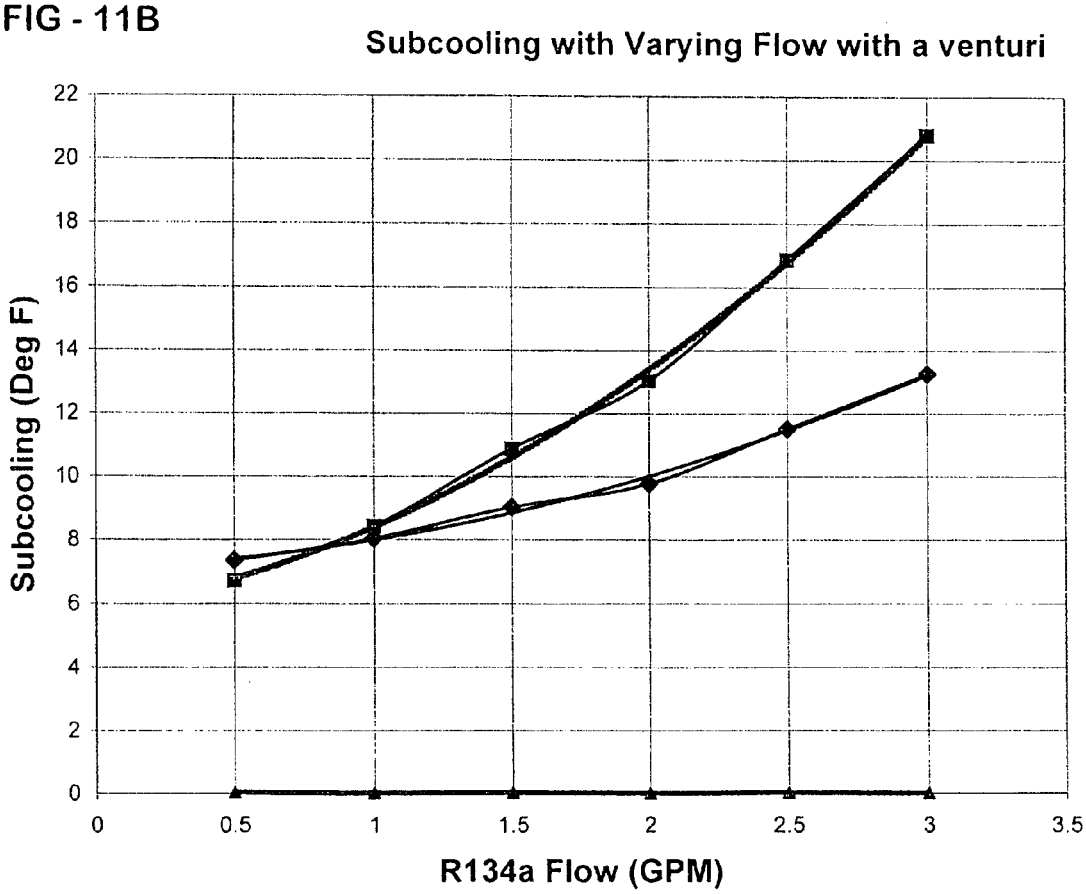
FIG. 11B is a graph of the data of FIG. 11A.

In the embodiment of FIGS. 9-12B, a closed system is provided in which fluid undergoes at least one or more phase changes. In FIGS. 9 and 10, a cooling system 200" is shown having a first phase change component 202", such as an evaporator. The first phase change component 202" receives a coolant, fluid, or refrigerant, such as R134*a* available from W. W. Granger, Inc. of Dayton, Ohio. In the first phase change component 202", the fluid undergoes a phase change from a liquid to a vapor as a result of a heat generating component 204", which may be of the form of the x-ray tube 12" mentioned earlier herein. Note that the first phase change component 202" may comprise a heat input, such as a fan 208" (FIG. 10), which forces air across the first phase change component 202" and into an area 210". By way of further example, note in FIG. 9 that the first phase change component 202" comprises an inlet 202*b*" and an outlet 202*a*" may comprise or be associated with the heat-generating component 204", such as the x-ray tube 12" mentioned earlier.

The fluid is pumped by pump 22" through conduit 18" to the first phase change component 202" through conduit 20" and then through an inlet 206*a*" of a second phase change component 206" wherein the fluid experiences a second phase change from vapor to liquid. The second phase change component 206" may be in the form of a condenser. In the embodiment being described, the first phase change component 202" provides an evaporator wherein the vapor resulting from the first phase change is delivered via conduit 20" to the second phase change component 206" as shown. The second phase change component 206" condenses the vapor back to a liquid state by providing a heat removal fluid loop 212" having a conduit 212*a*" that provides a cooling fluid, such as cooled water, to the second phase change component 206".

The inlet end 32" of venturi 30" is coupled via conduit 26" to an outlet 206*b*" of the second phase change component 206" as shown. Note that the venturi 30" has the throat 36" coupled to a reservoir tank 214" having a fluid 218" therein. The reservoir tank 214" is closed and provides a predetermined pressure to the throat 36" of venturi 30". The outlet end 34" of venturi 30" is coupled via conduit 28" to the inlet 22*b*" of pump 22" as shown.

With the venturi 30", a respectable amount of sub-cooling of fluid at the pump inlet 22*b*" is realized. This sub-cooling facilitates reducing or eliminating altogether any cavitation in the pump 22", especially at high-flow rates and/or at start up. The sub-cooling data for various points in the system during the experiment that utilized the venturi 30" are illustrated in the Table VI (FIG. 11A), and a conventional curve fitting routine was applied to the data to generate the graph in FIG. 11B.

Figure 12B:
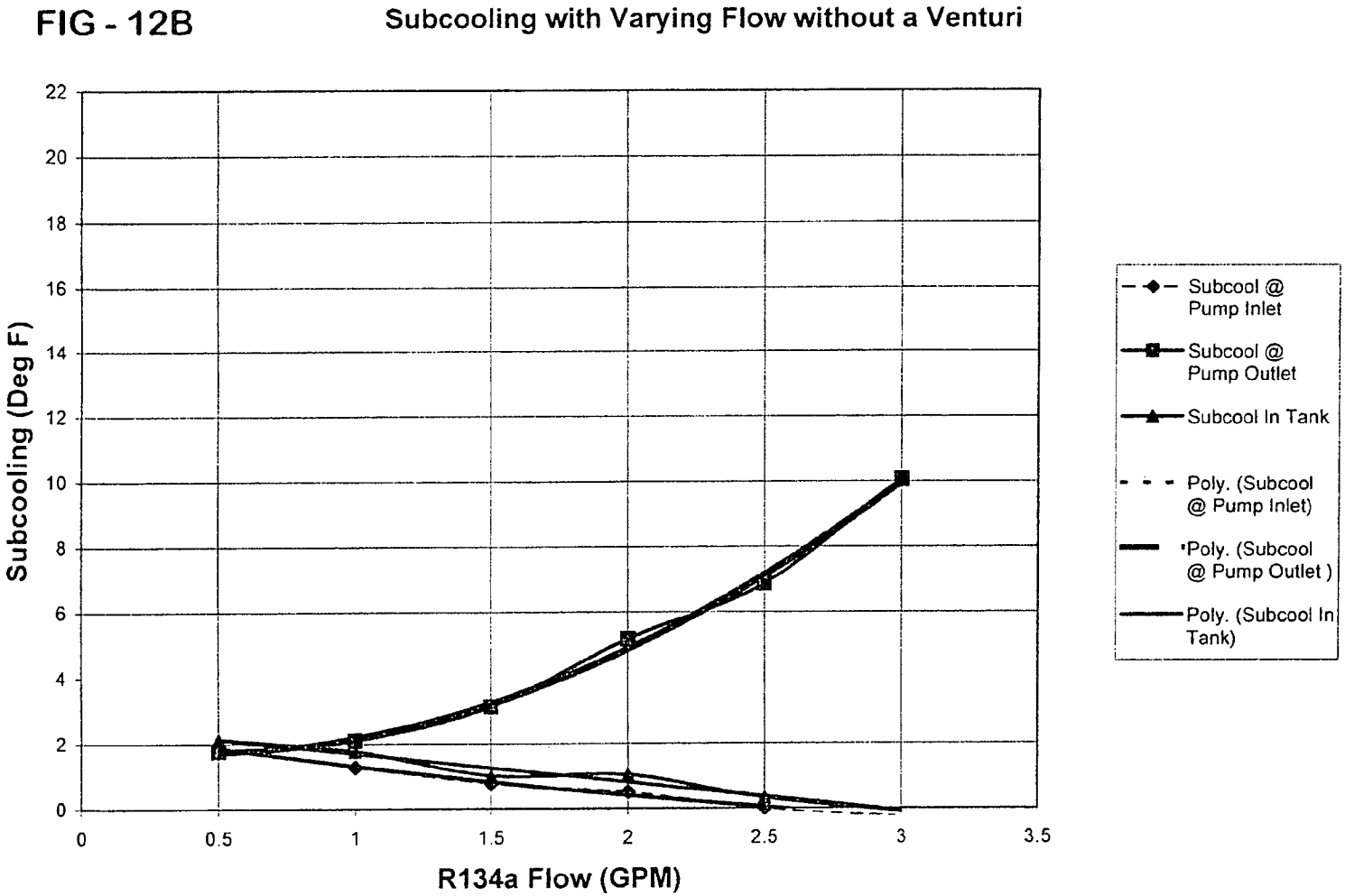
FIG. 12B is a graphical illustration of the data of FIG. 12A.

In contrast, a comparison was conducted using a system similar shown to that in FIGS. 9 and 10, but without a venturi 30". The cooling of the fluid at the pump inlet 22*b*" varied from 2 degrees Fahrenheit to no subcooling as flow varied from 0.5 gpm to 3.0 gpm as shown in Table VII (FIG. 12A). The curve fitting routine was used and applied to the data and resulted in the graphs shown in FIG. 12B.

Notice that with venturi 30", the pressure difference caused between the reservoir 214" and the inlet 22*b*" of the pump 22", as well as the rest of the components in the system 200". By creating this differential, the venturi 30" raised the overall pressure in the system 200" which in turn induced sub-cooling at the inlet 22*b*" of the pump 22", as well as in the rest of the system 200".

It was apparent from the test data that the venturi 30" raised the overall pressure in the system 200". As used herein, "sub-cooling" comprises a condition where liquid is cooler than saturation temperature. Cavitation in the pump 22" was substantially reduced or virtually eliminated. Providing the closed reservoir 214" coupled to the throat 36" of venturi 30" enabled pressurization of the entire system 200" which further facilitated sub-cooling at the inlet 22*b*" of the pump 22". This was found to be especially beneficial.

The venturi 30" in this embodiment and the embodiment referred to below may comprise dimensions similar to the dimensions illustrated relative to venturi 30, although other dimensions may be used as well shown in U.S. Pat. No. 6,623,160 (Table 3), but it should be understood that other dimensions may also be selected as well depending on the environment in which the venturi 30" is used.

Figure 13:
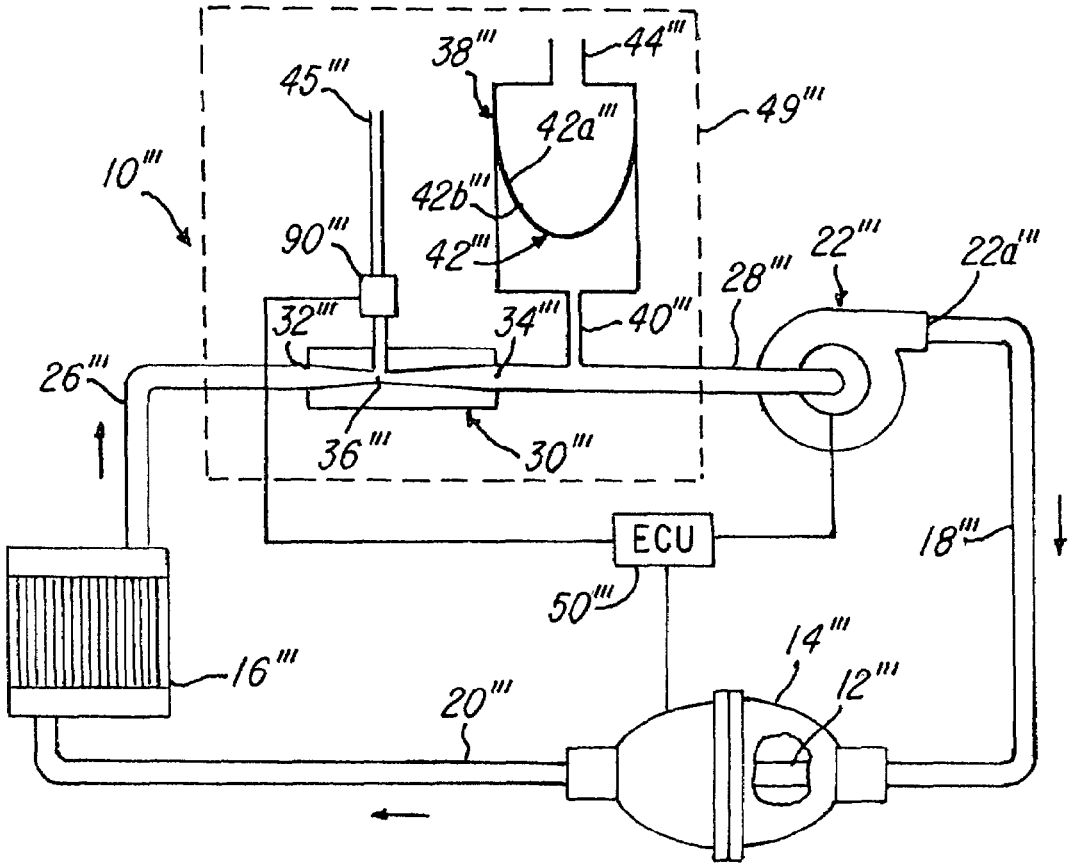
FIG. 13 is schematic view of another embodiment.

Referring now to FIGS. 13-14, another embodiment of the invention is shown. This embodiment is similar to the embodiment illustrated relative to FIGS. 1-8 and similar parts have been identified with the same part numbers, but with triple prime marks ("'''"). In this embodiment, a vacuum switch 90''' has been coupled to the throat 36''' as shown and the accumulator 38''' has been situated in place of the pressure switch 46 (FIG. 1) between the outlet 34''' of the venturi 30''' and the inlet of the pump 22''' as shown.

An advantage of this embodiment is that the vacuum switch 90''' can be used in place of a traditional pressure differential switch to energize or cause the heat generating component 12''', such as an x-ray tube, to turn off when there is no flow in the system 10'''. In this regard, it should be understood that because the accumulator is situated between the outlet 34''' of venturi 30''' and the inlet of the pump 22''' and the accumulator 38''' is at atmospheric pressure, a negative pressure will be experienced at the throat 36''' of the venturi 30'''. Data associated with various flow rates for the embodiment shown in FIG. 13 is illustrated in Table V of FIG. 14. Notice that as the flow rate increased, a negative pressure at the throat 36''' becomes more negative. The vacuum switch 90''' remains closed during all periods when pressure, such as a negative pressure, is realized at the throat 36''', which also represents a pressure drop at the throat 36'''. When there is zero flow, the pressure at the throat 36''' of venturi 30''' becomes less negative and the vacuum switch 90''' opens. This, in turn, generates a signal received by the ECU 50''' which causes the heat generating component 12''' to turn off. Thus, the vacuum switch 90''' in the embodiment illustrated in FIGS. 13-14 illustrate the use of the vacuum switch 90''' in combination with the venturi 30''' which provides means for activating and deactivating the heat generating component 12'''. Thus, this embodiment provides means for using the pressure at the throat 36''' to determine flow and to provide means for controlling the operation of the heat generating component 12'''. One advantage is that you can use the vacuum switch 90''' instead of a pressure differential switch which costs more. It works because the pressure on the other side of the vacuum is atmospheric and the pressure at the outlet 34''' of the venturi 30''' is connected to the diaphragm 42''' which is at atmospheric pressure, so one is measuring the differential pressure between the throat 36''' and the outlet 34''' of the venturi 30'''.

The accumulator 38''' can also be located at the inlet 32''' to the venturi 30''' as long as the pressure drop from the inlet of the venturi to the outlet 34''' of the venturi 30''' does not cause an excessive negative pressure at the inlet 32''' to the pump 22''' which induces cavitation.

While the method herein described, and the form of apparatus for carrying this method into effect, constitute preferred embodiments of this invention, it is to be understood that the invention is not limited to this precise method and form of apparatus, and that changes may be made in either without departing from the scope of the inventions, which is defined in the appended claims.

What is claimed is:

1. A closed heat transfer system comprising:

a pump for pumping fluid through the closed heat transfer system, said pump comprising a pump inlet and a pump outlet;

a first phase change component in which said fluid undergoes a phase change from liquid to gas;

a second phase change component coupled to said first phase change component, said fluid undergoing a second phase change from gas to liquid;

a venturi having a venturi inlet coupled to an outlet of said second phase change component and a venturi outlet coupled to said pump inlet; and a reservoir coupled to a throat of said venturi;

said reservoir providing a predetermined pressure at said throat;

said venturi being connected in series with said second phase change component and said pump.

2. The closed heat transfer system as recited in claim 1 wherein said predetermined pressure is a saturation pressure.

3. The closed heat transfer system as recited in claim 1 wherein said first phase change component comprises an evaporator.

4. The closed heat transfer system as recited in claim 1 wherein said second phase change component comprises a condenser.

5. A closed heat transfer system comprising:

a pump for pumping fluid through the closed heat transfer system, said pump comprising a pump inlet and a pump outlet;

a first phase change component in which said fluid undergoes a phase change from liquid to gas;

a second phase change component coupled to said first phase change component, said fluid undergoing a second phase change from gas to liquid;

a venturi having a venturi inlet coupled to an outlet of said second phase change component and a venturi outlet coupled to said pump inlet; and a reservoir coupled to a throat of said venturi;

said reservoir providing a predetermined pressure at said throat, wherein said first phase change component comprises an X-ray tube.

6. The closed heat transfer system as recited in claim 5 wherein said second phase change component comprises a condenser.

7. A method for reducing or preventing cavitation in a pump in a closed system in which a fluid changes phases between a liquid and a vapor, said method comprising the steps of:

situating a pump upstream of a first phase change component wherein said fluid changes state to a gas;

situating a second phase change component downstream of said first phase change component wherein said gas changes state to a liquid;

situating a venturi between said second phase change component and said pump; and situating a reservoir at a throat of said venturi, said reservoir providing a throat pressure at said throat that increases an overall system pressure so that said fluid entering said pump is subcooled;

said venturi being connected in series with said pump.

8. The method as recited in claim 7 wherein said first phase change component comprises an evaporator having a fan associated therewith.

9. The method as recited in claim 7 wherein said second phase change component comprises a condenser.

10. A method for reducing or preventing cavitation in a pump in a closed system in which a fluid changes phases between a liquid and a vapor, said method comprising the steps of:

situating a pump upstream of a first phase change component wherein said fluid changes state to a gas;

situating a second phase change component downstream of said first phase change component wherein said gas changes state to a liquid;

situating a venturi between said second phase change component and said pump; and situating a reservoir at a throat of said venturi, said reservoir providing a throat pressure at said throat that increases an overall system pressure so that said fluid entering said pump is subcooled;

wherein said first phase change component comprises an X-ray tube.

11. The method as recited in claim 10 wherein said second phase change component comprises a condenser.

12. A method for increasing pressure for controlling a heat-generating component in a closed-loop system comprising a plurality of components including a pump for pumping fluid in said system, the heat-generating component, a heat-rejection component and a conduit for coupling the plurality of components together, said method comprising the steps of:

situating a venturi in said closed-loop system; and providing a vacuum switch at a throat of said venturi;

situating an accumulator to the conduit with said conduit being in series with said venturi;

using said pump to cause flow in said closed-loop system;

sensing a throat pressure at said throat and causing said heat-generating component to turn off when said throat pressure at said throat becomes a predetermined negative pressure in response to said sensed pressure.

13. The method as recited in claim 12 wherein said method further comprises the step of:

connecting said accumulator between an outlet of the venturi and an inlet of said pump.

14. The method as recited in claim 13 wherein said predetermined pressure is a positive pressure.

15. The method as recited in claim 14 wherein said accumulator is situated upstream of said pump and downstream of said venturi.

16. The method as recited in claim 12 wherein said method further comprises the step of:

providing a vacuum switch for controlling the operation of said heat-generating component and causing said component to be turned on or off if a flow in said closed-loop system is above or below a predetermined flow rate.

17. The method as recited in claim 12 wherein said heat-generating component comprises an X-ray tube.

18. The method as recited in claim 12 wherein said method comprises the step of:

situating said accumulator downstream of said venturi.

19. The method as recited in claim 12, wherein said heat-generating component is an x-ray tube.

20. A cooling system for cooling a heat-generating component comprising:

a heat-rejection component;

a pump for pumping fluid to said heat-rejection component and said heat-generating component;

a conduit for communicating fluid among said heat-generating component, said heat-rejection component and said pump;

a venturi coupled to said conduit, said venturi having a throat;

an accumulator coupled to said conduit; and a switch coupled to said throat;

said switch also being coupled to a control unit that causes said heat-generating component to cease operating in response to a predetermined pressure at said throat;

said venturi being located in series with said pump.

21. The cooling system as recited in claim 20 wherein said predetermined pressure changes at said throat.

22. The method as recited in claim 21, wherein said predetermined pressure is negative.

23. The cooling system as recited in claim 20 wherein said switch is a vacuum switch.

24. The cooling system as recited in claim 20 wherein said accumulator is located upstream of said pump.

25. The cooling system as recited in claim 20 wherein said accumulator is located downstream of said venturi and upstream of said pump.

26. The cooling system as recited in claim 20 wherein said heat-generating component comprises an X-ray tube.

27. The cooling system as recited in claim 20 wherein said switch is a vacuum switch situated at said throat for generating a signal used to control operation of said heat-generating component when a flow rate of said fluid is not at a predetermined flow rate.

28. The cooling system as recited in claim 27 wherein said component comprises an X-ray tube.

29. The method as recited in claim 20, wherein said accumulator causes a pressure at an inlet of said pump to be at atmospheric pressure.

* * * * *